US009524710B2

(12) United States Patent
Mills

(10) Patent No.: US 9,524,710 B2
(45) Date of Patent: Dec. 20, 2016

(54) LO IMPEDANCE DUAL COIL BIFILAR MAGNETIC PICKUP

(75) Inventor: Steven E. Mills, Granger, IN (US)

(73) Assignee: Gibson Brands, Inc., Nashville, TN (US)

( * ) Notice: Subject to any disclaimer, the term of this patent is extended or adjusted under 35 U.S.C. 154(b) by 100 days.

(21) Appl. No.: 13/882,173

(22) PCT Filed: Oct. 28, 2011

(86) PCT No.: PCT/US2011/058190

§ 371 (c)(1),
(2), (4) Date: Aug. 1, 2013

(87) PCT Pub. No.: WO2012/058495

PCT Pub. Date: May 3, 2012

(65) Prior Publication Data

US 2013/0327202 A1 Dec. 12, 2013

Related U.S. Application Data

(60) Provisional application No. 61/407,799, filed on Oct. 28, 2010.

(51) Int. Cl.
*G10H 3/18* (2006.01)

(52) U.S. Cl.
CPC ..... *G10H 3/181* (2013.01); *G10H 3/18* (2013.01); *G10H 3/182* (2013.01); *G10H 2220/515* (2013.01)

(58) Field of Classification Search
CPC ..... G10H 3/18
USPC ..... 84/726
See application file for complete search history.

(56) References Cited

U.S. PATENT DOCUMENTS 3,711,619 A * 1/1973 Jones ..... G10H 3/181 84/726
3,962,946 A * 6/1976 Rickard ..... G10H 3/182 84/726
4,069,732 A * 1/1978 Moskowitz ..... G10H 3/183 84/727
4,164,163 A * 8/1979 Rhodes ..... G10H 3/182 84/728
4,372,186 A * 2/1983 Aaroe ..... G10H 3/181 84/725
4,378,722 A * 4/1983 Isakson ..... G10H 3/185 84/726
4,854,210 A * 8/1989 Palazzolo ..... G10H 3/181 84/726

(Continued)

FOREIGN PATENT DOCUMENTS

WO 9503686 A1 2/1995

OTHER PUBLICATIONS

European Search Report and Written Opinion of the European Patent Office; Feb. 18, 2016; p. 1-8; European Patent Office, Munich, Germany.

*Primary Examiner* — David Warren
*Assistant Examiner* — Christina Schreiber
(74) *Attorney, Agent, or Firm* — Bates & Bates, LLC; Kathryn Cox; Andrea Bates

(57) ABSTRACT

A bifilar pickup for an electrical stringed musical instrument is provided. The bifilar pickup comprises a dual coil wherein at least one coil is formed with two closely spaced bifilar parallel wound wires. A guitar in combination with the pickup unit is additionally provided.

15 Claims, 5 Drawing Sheets

(56) References Cited

U.S. PATENT DOCUMENTS 5,389,731 A * 2/1995 Lace ..... G10H 3/181 84/726
5,523,526 A * 6/1996 Shattil ..... G01R 33/42 84/728
5,789,691 A * 8/1998 Stich ..... G10H 3/181 84/726
5,908,998 A * 6/1999 Blucher ..... G10H 3/181 84/723
5,949,014 A * 9/1999 Rashak ..... G10H 3/181 84/723
6,103,966 A * 8/2000 Kinman ..... G10H 3/181 84/728
6,291,759 B1 * 9/2001 Turner ..... G10H 3/181 336/110
6,525,258 B1 * 2/2003 Powers ..... G10H 3/182 84/728
7,166,793 B2 * 1/2007 Beller ..... G10H 3/181 84/723
7,189,916 B2 * 3/2007 Kinman ..... G10H 3/181 84/726
7,227,076 B2 * 6/2007 Stich ..... G10H 3/181 84/726
7,989,690 B1 * 8/2011 Lawing ..... G10H 3/181 84/723
8,309,836 B1 * 11/2012 Bolger ..... G10H 3/143 84/723
8,319,088 B1 * 11/2012 Harari ..... G10H 3/181 84/727
8,680,389 B2 * 3/2014 Yamanaka ..... G10H 3/181 84/723
8,791,351 B2 * 7/2014 Kinman ..... G10H 3/181 84/723
8,907,199 B1 * 12/2014 Dixon ..... G10H 3/181 84/726
9,165,545 B2 * 10/2015 Gelvin ..... G10H 3/181
2002/0020281 A1 * 2/2002 Devers ..... G10H 3/181 84/728
2002/0069749 A1 * 6/2002 Hoover ..... G10H 3/26 84/738
2002/0073829 A1 * 6/2002 Gaglio ..... G10H 3/181 84/726
2002/0073830 A1 * 6/2002 Petherick ..... G10H 3/181 84/726
2005/0117469 A1 * 6/2005 Song ..... G11B 7/0933 369/44.15
2012/0118129 A1 * 5/2012 Jang ..... G10H 3/143 84/726
2013/0239788 A1 * 9/2013 Mills ..... G10H 3/181 84/726
2013/0312591 A1 * 11/2013 Mills ..... G10H 3/181 84/726
2013/0327202 A1 * 12/2013 Mills ..... G10H 3/181 84/726
2014/0245877 A1 * 9/2014 Gelvin ..... G10H 3/181 84/727

* cited by examiner

LO IMPEDANCE DUAL COIL BIFILAR MAGNETIC PICKUP

CROSS-REFERENCE TO RELATED APPLICATION

This Application claims priority to U.S. Provisional Patent Application Ser. No. 61/407,799, filed Oct. 28, 2010, and PCT Patent Application No. PCT/US2011/058190, filed Oct. 28, 2011, both of which are hereby incorporated by reference in their entirety.

TECHNICAL FIELD

The field of the disclosure relates generally to the construction of transducers for converting the vibration of the strings of electrical musical instruments into a measurable voltage. More particularly, the disclosure relates to the construction of electromagnetic dual coil bifilar pickups.

BACKGROUND

Electromagnetic pickup devices are used in conjunction with stringed musical instruments such as electric guitars and basses to convert the vibrations resulting from the movement or "picking" of the strings into electrical signals, for subsequent transmission to amplification devices to produce a desired sound. The pickup is generally positioned under the strings of the instrument on the base surface and the signal transmitted by an electromagnetic pickup is dependent upon the motions of each string.

The most essential components of a dual coil pickup are a permanent magnet and two coils of wire. Generally, two oppositely polarized magnets will be used although in some embodiments, only a single bipolar magnet is incorporated into the embodiments. The magnets generate a magnetic field that passes through the pickup coils and also extends into a space occupied by at least one string of the instrument. Vibration of the string changes the reluctance of the magnetic path and creates disturbances in the magnetic field proportional to the string vibration. The changing magnetic field in the pickup coils in turn induces an electrical signal in the coils. From the output of the pickup, a circuit connection is made to an amplifier.

There are several types of pickups with varying coil configurations known in the art. One type of electromagnetic pickup device is a dual coil pickup or a humbucking pickup. In a humbucking pickup, two coils are associated or connected in a manner so as to reduce hum.

As a rule, a central design problem of any pickup is that of obtaining both a faithful signal and a good signal to noise ratio. It is well known that the pickup coils, in addition to their desired function of picking up string vibrations, also tend to pick up electrical noise and interference signals from various extraneous sources. Also, because of the impedance associated with common dual coil pickups, frequency response may be limited. Therefore, there is significant value in a pickup that has improved noise rejection of radiated frequencies from extraneous sources and extending the frequency response while still maintaining response to desirable string vibrations.

SUMMARY

In one aspect, the present disclosure is directed toward a dual coil transducer wherein at least one of the coils has two wires wound side by side in the same direction with coaxial turns. In one embodiment, the two coils are additionally electrically connected to each other.

In addition to the coils, the pickup comprises at least one magnet and potentially bobbins and pole pieces. The coils may be directly wound around the permanent magnets or pole pieces or alternatively may be wound around the bobbin and then the bobbin is placed around the pole pieces.

Consistent with yet a further aspect of the disclosure, a guitar with a disclosed pickup is claimed.

DETAILED DESCRIPTION

Before describing the exemplary embodiments in detail, it is to be understood that the embodiments are not limited to particular apparatuses or methods, as the apparatuses and methods can, of course, vary. It is also to be understood that the terminology used herein is for the purpose of describing particular embodiments only, and is not intended to be limiting. Unless defined otherwise, all technical and scientific terms used herein have the same meaning as commonly understood by one of ordinary skill in the art to which an embodiment pertains. Many methods and materials similar, modified, or equivalent to those described herein can be used in the practice of the current embodiments without undue experimentation.

As used in this specification and the appended claims, the singular forms "a", "an" and "the" can include plural referents unless the content clearly indicates otherwise. Thus, for example, reference to "a component" can include a combination of two or more components.

Figure 1:
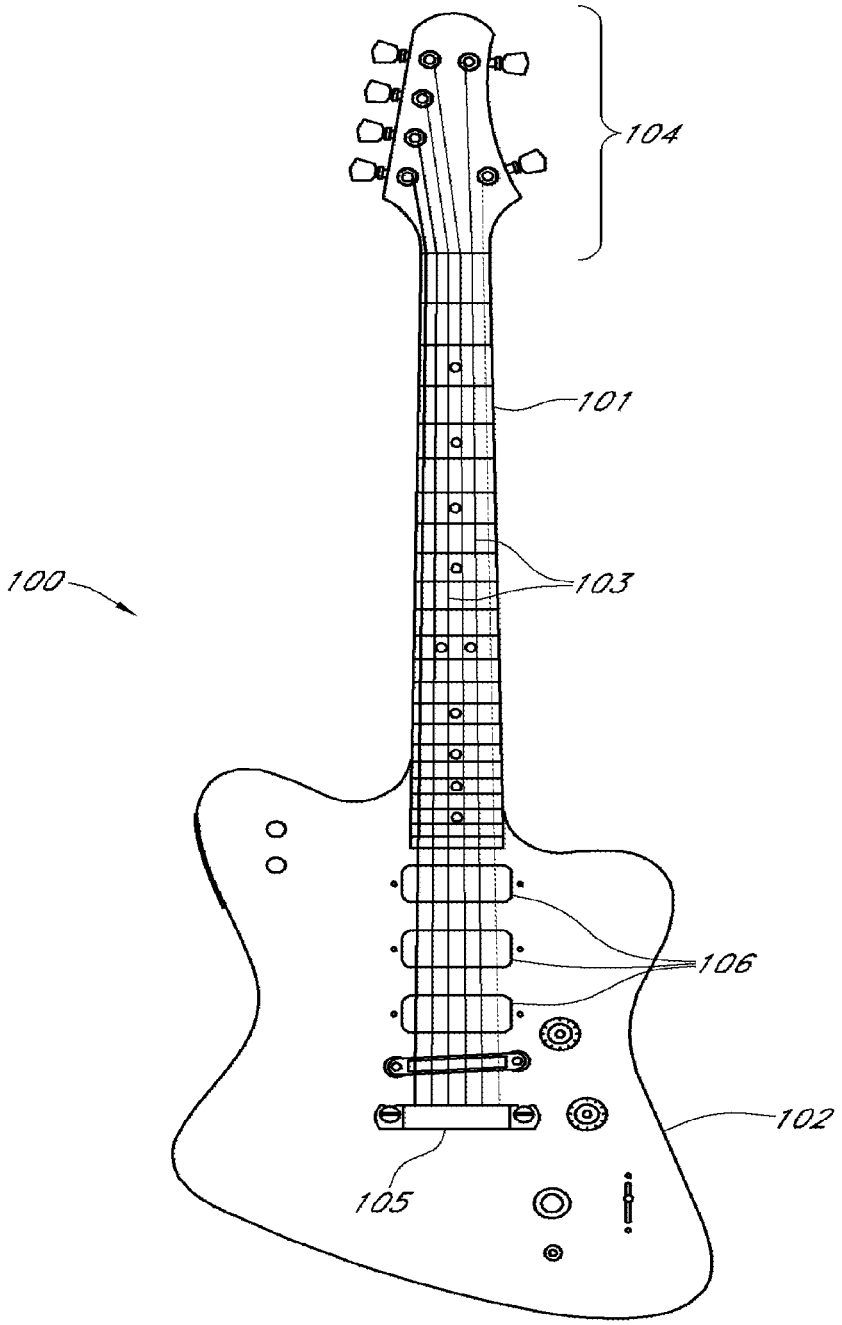
FIG. 1 depicts a front elevational view of a stringed electrical musical instrument with the pickups of the present disclosure.

Exemplary embodiments of the dual coil bifilar pickup will now be explained with reference to the figures. This description is provided in order to assist in the understanding of the invention and is not intended to limit the scope of the invention to the embodiments shown in the figures or described below. As used herein, a "coil" is a wound spiral of two or more turns of wire used to conduct current. FIG. 1 demonstrates a stringed electrical musical instrument. In the embodiment of FIG. 1, the stringed instrument is a six stringed guitar. However, the components and advantages currently disclosed are applicable to other types of stringed instruments, such as bass guitars, ukuleles, mandolins, violins or guitars with a different number of strings. Referring now to FIG. 1, guitar 100 comprises a neck 101 and a main body 102. The guitar 100 includes guitar strings 103 that are secured on one end to a tuning head 104 and on the other end to a bridge 105 in a manner well known in the art.

FIG. 1 further demonstrates a pair of pickup units 106 arrayed beneath the strings 103 and secured onto the face of the main body 102 of the guitar in a conventional manner. In certain aspects, pickup units 106 are fitted into apertures in main body 102. In order for the disclosed pickups to function as desired, strings 103 must be made from a magnetizable material such that pickup can electromagnetically interact with strings 103. The pickups may be placed in various positions on the main body 102 of the guitar. Pickups placed near bridge 105 are generally called bridge pickups, whereas pickups placed adjacent to neck 101 are called neck pickups. The embodiments disclosed may be use as both bridge and neck pickups. Furthermore, more than one pickup may be used with a stringed electrical musical instrument. In the event more than one pickup is used, the pickups may be connected via switches such that one, or more than one, may transmit at a time. This type of switching is well known in the art and examples can be found in U.S. Pat. No. 5,780,760, hereby incorporated by reference. The pickups disclosed may also be used with other types of pickups such as traditional single coil or traditional humbucking pickups.

Pickup units 106 comprise at least one permanent magnet 108 and at least two coils 110. The embodiment of FIG. 2 demonstrates a pickup unit with two permanent magnets and two coils. Although the embodiment in FIG. 2 demonstrates use of the permanent magnets as pole pieces, other exemplary pickup units 106 may also include pole pieces of different types. The particular pole piece is not limiting and any magnetizable material in contact with the permanent magnet 108 to produce an electro-magnetic field is contemplated. For example, in one embodiment, the pole pieces are adjustable threaded steel poles. Nevertheless, certain embodiments will have non-adjustable pole pieces. In yet other embodiments, there may be both adjustable and non-adjustable pole pieces. In addition to embodiments having a pole piece for each string, pole pieces may also be shaped as a blade or as a rail.

Figure 4:
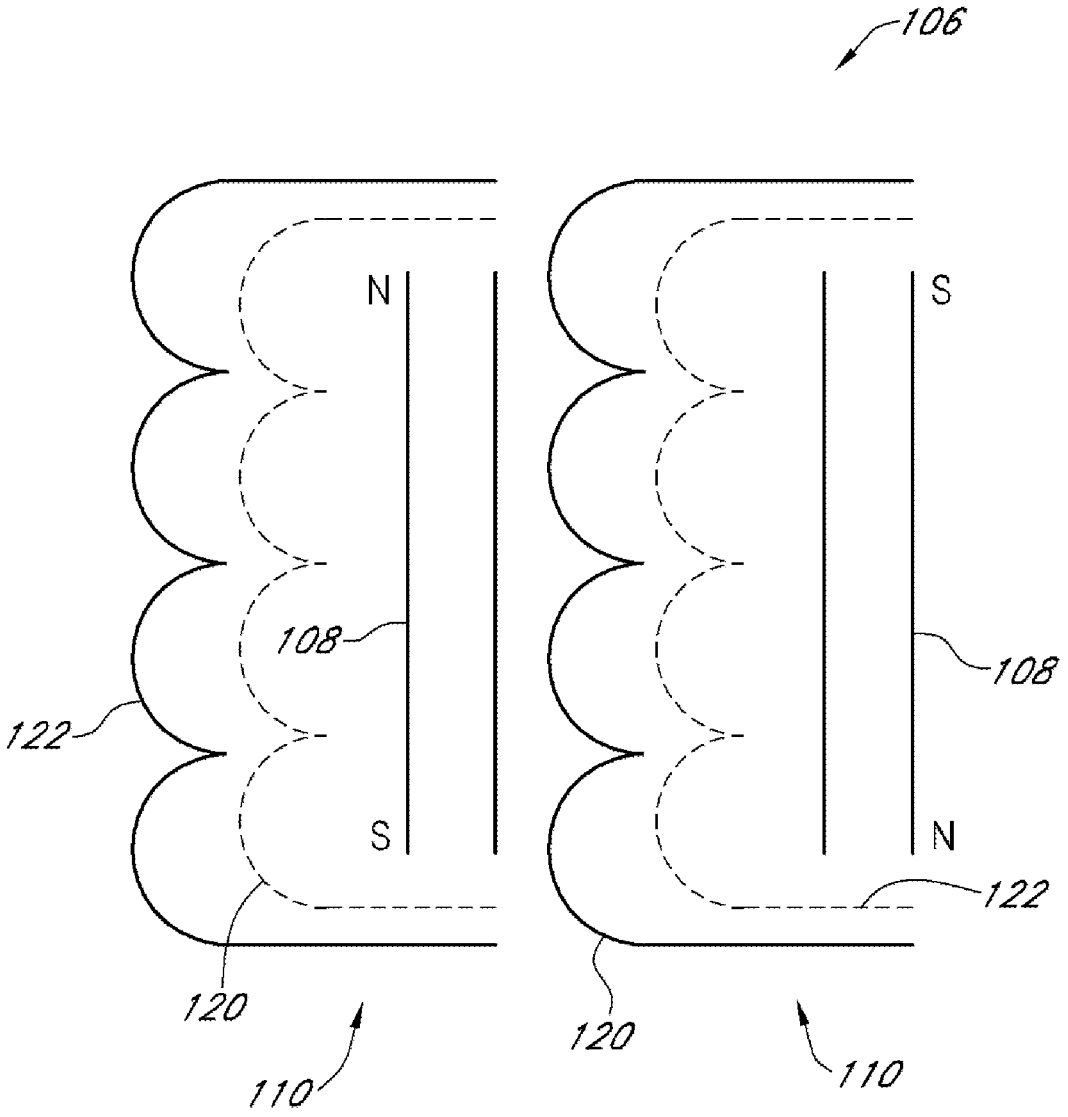
FIG. 4 is a schematic diagram of the circuitry of the dual coil bifilar pickup wiring.

The dual coil type device may include a pickup cover (or cap) 109 as well as spacers 111, which align and stabilize the coils, bobbins 116, and base 118. Although not shown in FIG. 5, a pickup trim ring is also contemplated. A pickup cover, spacers, and pickup trim ring may also be used with the single coil pickup shown in FIG. 2. As understood by the skilled artisan, different types of covers, spacers, and pickup trim rings may be used without changing the character of the invention. Generally, at least one of the two coil forms has two wires wound in a parallel manner with coaxial turns. The electrical diagram of the dual coil bifilar wiring, without showing the connection between the coils 110, is demonstrated in FIG. 4. In the dual coil pickup of FIG. 4, the two coils are substantially identical, with each coil having two wires, 120 and 122, and two permanent magnets 108 with transverse polarity.

The magnets used in exemplary embodiments of the pickup units 106 are not meant to be limiting. Several different types of permanent magnets, such as Alnico, ceramic, and samarium-cobalt are contemplated. Depending on the embodiment, the number and shape of the magnets may also vary. In one embodiment, the pickup unit 106 has two permanent magnets 108. In another embodiment, pickup unit 106 has one permanent magnet 108. If Alnico permanent magnets are used, they may be either cylindrical or bar-shaped. In embodiments which use Alnico magnets, the grade of the magnet may be Alnico 5, Alnico 2, Alnico 3, Alnico 4, Alnico 7 or Alnico 8. In one embodiment, a bar-shaped Alnico 5 magnet is used. In embodiments with more than a signal magnet, use of different types and/or shapes of magnets within a single pickup are contemplated.

Examples of specific magnet sizes and shapes that may be used in embodiments of the invention include, but are not limited to, a ceramic 5, ceramic 8, an Alnico 2, or an Alnico 5 magnet that is rectangular with a length of about 2 inches, a width of about 0.5 inch and a depth of about 0.12 inch. While a particular polarity is shown for permanent magnets 108 in FIG. 4, the polarity may be reversed without affecting the operation of the pickup.

Figure 2:
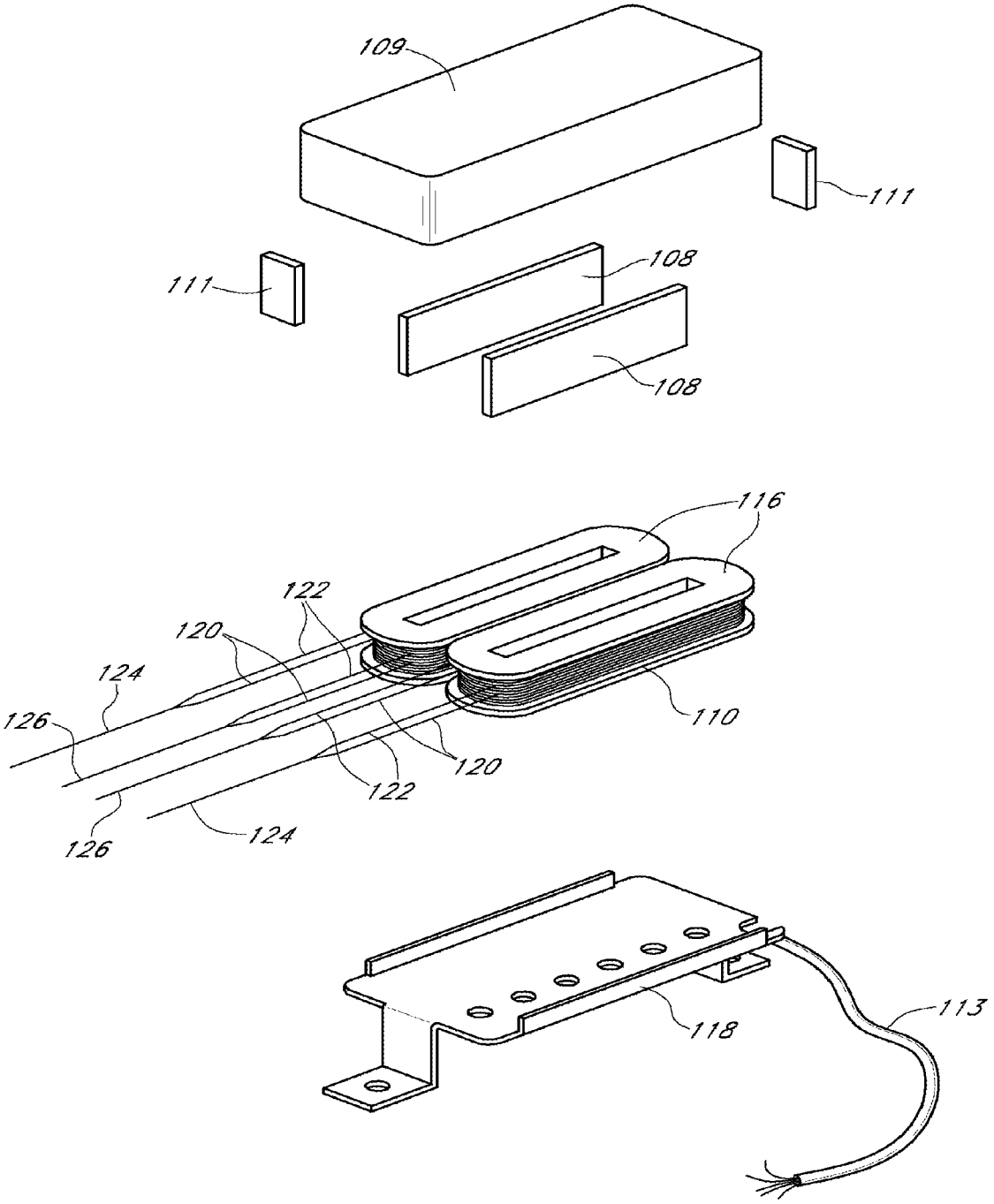
FIG. 2 illustrates the common pieces of a dual coil pickup.

Coil 110 is constructed by winding at least two wires in a bifilar manner. In the embodiment of FIG. 2, coil 110 is constructed by first winding two wires around bobbin 116, which is then placed around pole pieces, which concentrate the magnetic field from permanent magnets 108, which are under the bobbin. In some embodiments the bobbin has a web containing bores adapted for containing the pole pieces. The skilled artisan may directly wind wire around the pole pieces or magnet 108 in some embodiments. Bobbin 116 may be made of any non-conductive material. In some embodiments, bobbin 116 is made from plastic such as nylon. In other embodiments, bobbin 116 is made from wood. In many embodiments, it is preferable to make bobbin 116 from material that is an electrical insulator.

As is well understood by the skilled artisan, the shape of the coil form may vary depending on the type of pickup sound being sought. In many embodiments, the coil form will be a generally rectangle shape with soft corners, such as the coil form in FIG. 3.

Figure 3:
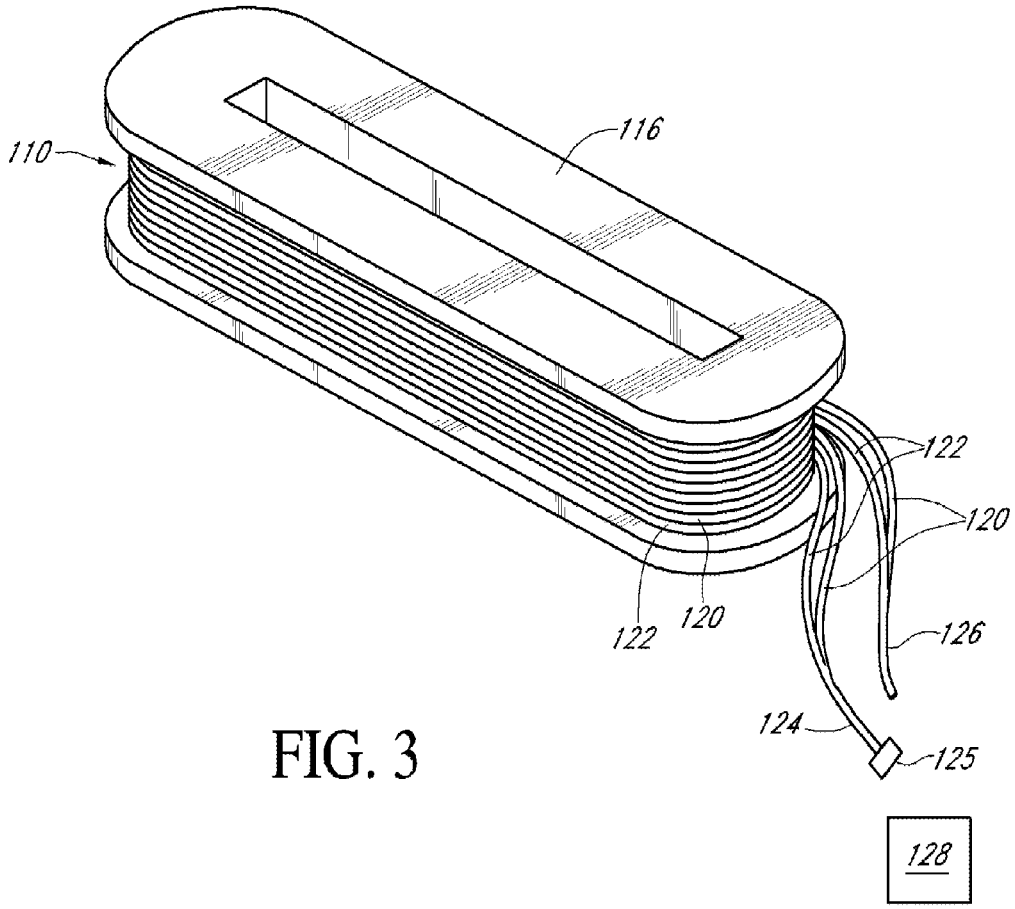
FIG. 3 demonstrates a close-up view of the bifilar winding of at least one of the coils.

FIG. 3 demonstrates the detail of the winding of coil 110. In embodiments of the invention, a bifilar coil is created by simultaneously winding two insulated wires 120 and 122 side by side in a parallel direction with coaxial turns. Wire 120 and wire 122 are electrically connected to each other on the ends of the wires but may be isolated from each other in the turns. They may be associated within tubing or bonded together. In exemplary embodiments, the wires from the two coils 110 may be shielded with tubing 113 as the wires leave the pickup for connection to the musical instrument wiring. Winding in a bifilar manner allows for a low impedance coil.

The first lead assembly 124 of wires 120/122 can be connected to a switch, the jack of an amplification device, or a ground through a coil output or can be connected to another coil. Second lead assembly 126 of wires 120/122 can also be connected to a switch, the jack of an amplification device, or the ground through a coil output or can be connected to another coil. In some embodiments, when the lead assemblies of different coils are connected to each other, the remaining lead assembly of each coil will be connected to an output, where the output is a switch, a jack, or a ground.

The wire gauges used for coil 110 can be of any predetermined gauge. As is well understood by the skilled artisan, the desired tonality and output of the pickup device may be achieved by using a variety of gauges. For example, some embodiments use American Wire Gauge (AWG) 38 or AWG 40 or AWG 42 or AWG 43 or AWG 44. In an exemplary embodiment AWG 42 is used for both wire 120 and wire 122.

Generally, the wires 120 and 122 are insulated copper wire. The copper wire may be enameled. Different types of insulation are known in the art and are not limiting when used with exemplary embodiments. For example, in other embodiments wires 120 and 122 may be insulated with polysol or polyurethane.

Various numbers of turns of wires 120 and 122 can be used in embodiments of the invention. As is well understood in the art, the number of turns of wire on a particular coil 110 contributes to a particular pickup sound. Therefore, the turns of wire 120 and wire 122 can be varied depending on the type of sound desired. In most embodiments, wire 120 and wire 122 will have an equal number of turns. In one embodiment, coil 110 consists of about 4000 turns of both wire 120 and wire 122. In other embodiments, coil 110 consists of about 5000 turns. In yet another embodiment, wire 120 and wire 122 have less than about 2500 turns, between about 2500 and 3500 turns, or between about 3500 and 4000 turns.

Although each coil in the dual coil pickup forms an independent low impedance circuit and can function as an independent single coil, such as is well known in the art, in certain embodiments, the two coils 110 will be connected in a manner to form a lower impedance circuit capable of high output. In certain embodiments of the dual coil bifilar pickup, only one coil 110 will be wound with two wires whereas the other coil 110 will only be wound with a single wire. In some embodiments, the two coils 110 will be connected side-by-side. In other embodiments, the two coils 110 will be stacked. Generally, a dual coil pickup is any pickup with two coils having opposing electric and magnetic polarity capable of electrically affecting each other.

Figure 5:
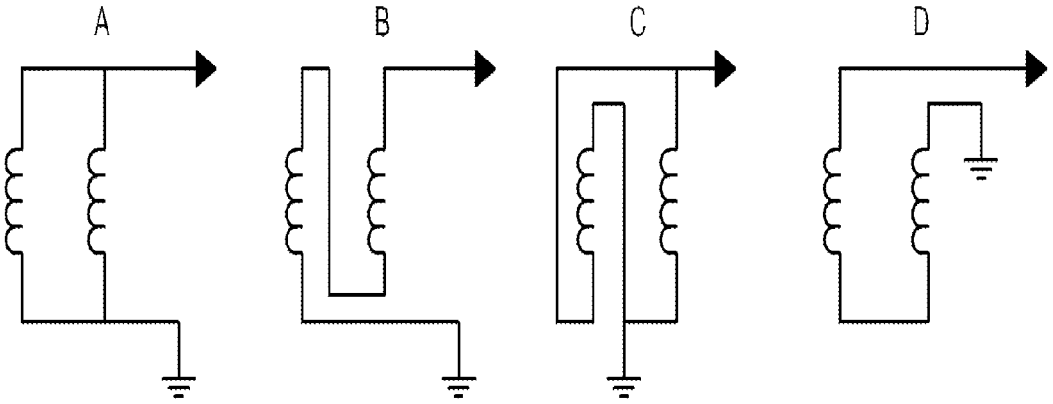
FIG. 5 depicts schematic circuit diagrams of common modes of connection of the dual coils; A—In phase, parallel; B—In phase, series; C—Out of phase, parallel; D—Out of phase, series.

In the embodiment of FIG. 2 and FIG. 3, both coils are wound in the same direction. The two coils in the dual coil pickup unit 106 may be connected in a variety of manners. For example, the two coils may be connected in phase parallel, in phase series, out of phase parallel and out of phase series. FIG. 5 demonstrates example electrical configurations of the connection between the dual coil pickups.

Any aspect or design described herein as "exemplary" is not necessarily to be construed as preferred or advantageous over other aspects or designs. Exemplary embodiments may be implemented as a method, apparatus, or article of manufacture. The word "exemplary" is used herein to mean serving as an example, instance, or illustration.

From the above discussion, one skilled in the art can ascertain the essential characteristics of the invention, and without departing from the spirit and scope thereof, can make various changes and modifications of the embodiments to adapt to various uses and conditions. Thus, various modifications of the embodiments, in addition to those shown and described herein, will be apparent to those skilled in the art from the foregoing description. Such modifications are also intended to fall within the scope of the appended claims.

What is claimed is:

1. A pickup for a stringed electrical musical instrument comprising: a humbucking pickup with at least two permanent magnets; and a coil associated with each magnet, wherein at least one coil is wound with at least two non-ferromagnetic copper wires, further wherein the at least two wires are wound in a parallel manner with coaxial turns, and yet further wherein the at least two wires are electrically connected to each other on at least one end but electrically isolated from each other in the coaxial turns.

2. The pickup of claim 1, wherein the at least two permanent magnets are oppositely polarized permanent magnets.

3. The pickup of claim 2 wherein the two oppositely polarized permanent magnets are Alinco 5 magnets.

4. The pickup of claim 1, wherein the at least two coils are electrically connected.

5. The pickup of claim 4, wherein the at least two electrically connected coils are connected in phase parallel, in phase series, out of phase parallel, or out of phase series.

6. The pickup of claim 1, further comprising two bobbins, wherein each bobbin is associated with one of the at least two magnets, further wherein at least one coil is wound around one of the two bobbins.

7. The pickup of claim 1 wherein the at least two wires are wound about 4000 times.

8. The pickup of claim 1 wherein the at least two wires are insulated copper AWC 44.

9. A stringed electrical musical instrument comprising: a guitar; and a humbucking pickup mounted on the guitar, wherein the pickup comprises at least two permanent magnets; and coil associated with each magnet, wherein at least one coil is wound with at least two non-ferromagnetic copper wires, further wherein the at least two wires are wound in a parallel manner with coaxial turns, and yet further wherein the at least two wires are electrically connected to each other on at least one end.

10. The stringed electrical musical instrument of claim 9 wherein the coils are electrically connected.

11. The stringed electrical musical instrument of claim 10, wherein the electrically connected coils are connected in phase parallel, in phase series, out of phase parallel, or out of phase series.

12. The stringed electrical musical instrument of claim 9, wherein the at least two permanent magnets are two oppositely polarized magnets.

13. The stringed electrical musical instrument of claim 9 wherein the coils are attached to a single base.

14. The stringed electrical musical instrument of claim 9 wherein the at least two wires are wound about 4000 times.

15. The stringed electrical musical instrument of claim 9 wherein the at least two wires are insulated copper AWC 44.

* * * * *